United States Patent [19]

Fujiwara

[11] 4,425,188

[45] Jan. 10, 1984

[54] FORMING SHOES FOR THE TWIN-WIRE FORMER OF A PAPER MAKING MACHINE

[75] Inventor: Haruyoshi Fujiwara, Mihara, Japan

[73] Assignee: Mitsubishi Jukogyo Kabushiki Kaisha, Tokyo, Japan

[21] Appl. No.: 358,604

[22] Filed: Mar. 15, 1982

[30] Foreign Application Priority Data

Mar. 28, 1981 [JP] Japan ..... 56-44016[U]

[51] Int. Cl.[3] ..... D21F 1/36; D21F 1/54

[52] U.S. Cl. ..... 162/300; 162/301; 162/352

[58] Field of Search ..... 162/300, 301, 352, 374

[56] References Cited

U.S. PATENT DOCUMENTS

| | | | |
|---|---|---|---|
| 1,826,735 | 10/1931 | Cofrin | 162/352 |
| 3,017,928 | 1/1962 | Pedrick | 162/374 |
| 3,726,758 | 4/1973 | Parker et al. | 162/301 X |
| 3,874,998 | 4/1975 | Johnson | 162/374 |
| 3,941,651 | 3/1976 | Koski | 162/301 |
| 3,944,464 | 3/1976 | Means | 162/352 X |

*Primary Examiner*—Richard V. Fisher

*Attorney, Agent, or Firm*—Wenderoth, Lind & Ponack

[57] ABSTRACT

A twin wire former of a paper making machine in which one of the wires is supported on a surface of each of a number of forming shoes longitudinally spaced along the extent of the wires. Each forming shoe has a number of longitudinally spaced grooves in the surface contacted by the one wire, each of the grooves extending in a direction at an angle to the longitudinal direction less than 90°, such that scraping pressure applied to the raw material liquid guided between the two wires, by the surface between the grooves is released into the grooves. This arrangement of grooves creates a pressure difference in the raw paper material liquid in a direction transverse to the longitudinal direction of the wires to produce a transverse flow of the raw paper material liquid, thereby reducing the machine-direction to cross-machine-direction ratio of the fibers of the paper being formed.

2 Claims, 4 Drawing Figures

FORMING SHOES FOR THE TWIN-WIRE FORMER OF A PAPER MAKING MACHINE

BACKGROUND OF THE INVENTION

The invention relates to forming shoes in a stationary dewatering element for a paper making machine and more particularly to forming shoes within a twin wire former thereof, and to forming shoes which are applicable to the blade of a deflector, the cover plate of a wet box, a suction box, etc.

In one prior arrangement of forming shoes which have previously been used in an upright type twin wire former, raw material supplied from a head box is guided into a narrow path formed by a No. 2 wire and a No. 1 wire. In this instance, the No. 2 wire is supported by forming shoes arranged at given spaced intervals.

Along the path of the paper being formed a pressure difference arises between those portions instantaneously supported by the forming shoes and the other portions. This pressure difference causes local flows to occur both in the direction of travel of the wires and in the opposite direction; these local flows improve the sheet formation and quality of the paper being formed by means of such twin-wire former. On the other hand, however, in the event that this pressure difference becomes too great, short-comings arise in that the retention rate is lowered and the machine-direction to cross-machine-direction ratio becomes large, because the fibres are liable to align themselves in the direction of travel of the wires. It is to be noted that, in these devices the contact surfaces of the shoes with the wire is smooth.

OBJECTS AND SUMMARY OF THE INVENTION

An object of this invention is to eliminate the aforementioned shortcomings of the prior art.

According to the present invention, there are provided forming shoes in a twin wire former of a paper making machine, the shoes having grooves formed in their surfaces in contact with a wire which extend at an angle of less than 90° with respect to the direction of travel of the wire, the arrangement being such that a scraping pressure is released and at the same time a pressure difference is created in the transverse direction with respect to the wire along the contact surface of the shoes to produce a flow of raw material liquid also in the transverse direction, thereby to reduce the machine-direction to cross-machine-direction ratio of the paper, so that an improvement in retention rate as well as in machine-direction to cross-machine-direction ratio may be achieved.

BRIEF DESCRIPTION OF THE DRAWINGS

In order that the invention may be readily understood, and further features made apparent, one preferred embodiment of the invention will now be described with reference to the accompanying drawings in which.

DETAILED DESCRIPTION OF THE PREFERRED EMBODIMENT

Figure 1:
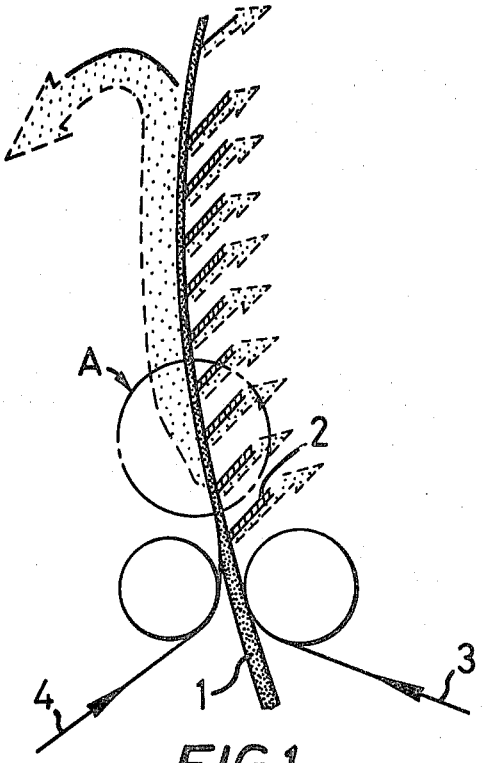
FIG.1 PRIOR ART
FIG. 1 is a schematic view showing an arrangement of forming shoes of the prior art.

FIG. 1 shows an arrangement of forming shoes which have previously been used in an upright type twin wire former. Raw paper material liquid 1 supplied from a head box is guided into a narrow path formed by a number 2 wire 3 and a number 1 wire 4. The number 2 wire 3 is supported by forming shoes 2 which are arranged at given intervals.

Figure 2:
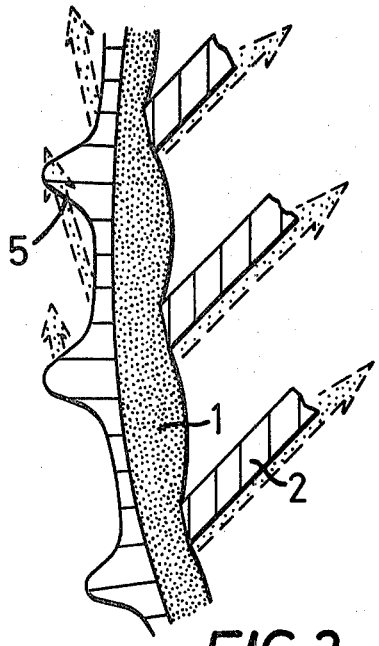
FIG.2 PRIOR ART
FIG. 2 is a more detailed representation of that part within the circle A in FIG. 1.

As is shown in FIG. 2, the variation in the watering pressure along the path of the paper being formed as represented by the pressure diagram 5 arises between those portions instantaneously supported by the forming shoes 2 and the other portions. This pressure difference causing local flows to occur both in the direction of travel of the wires and in the opposite direction. These local flows improve the sheet formation and the quality of the paper being formed by means of such twin-wire former. On the other hand, in the event that this pressure difference becomes too great the above-described problems of reduced retention rate and increased machine-direction to cross-machine-direction ratio can occur as the fibers are liable to align themselves in the direction of travel of the wires.

Figure 3:
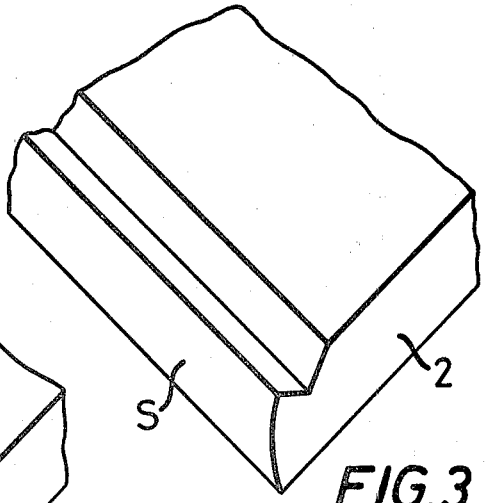
FIG.3 PRIOR ART
FIG. 3 is a perspective view showing a part of a forming shoe of FIG. 1.

As is shown in FIG. 3, the contact surface S of the prior forming shoe 2 is smooth.

Figure 4:
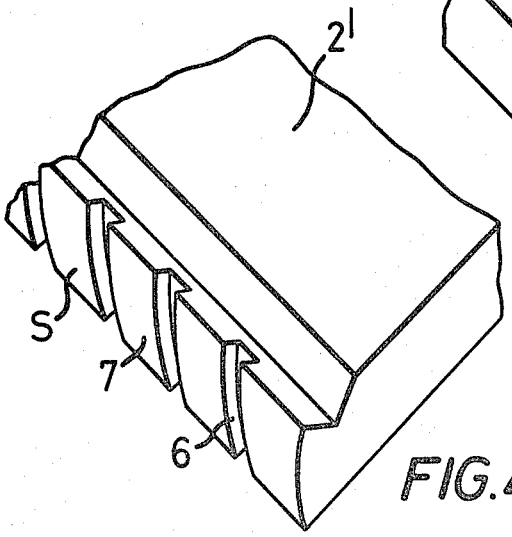
FIG. 4 is a perspective view showing a part of a forming shoe according to the preferred embodiment.

Referring to FIG. 4, the basic structure of a forming shoe 2' according to the preferred embodiment of the invention is shown. The shoe 2', which could be made of any material such as ceramics, high-molecular polyethylene, tungsten carbide, etc. is formed with a number of grooves 6, which are orientated and spaced apart in such a mannner that pressure which tends to build up on the surface S in contact with a wire in front of the shoe can be released into the grooves.

Accordingly, the orientation of the grooves 6 could be either parallel to, or oblique to, the direction of travel of the wires. In other words, the grooves are provided perpendicularly to their depths at an angle of less than 90° with respect to the direction of travel of the wires. In addition, the width, depth and spacing pitch of the grooves 6 are so chosen that they will not produce ill-effects, such as streaks, upon the sheet of paper being formed.

In operation, raw material 1 which is sandwiched between the wires 3 and 4 as shown in FIG. 1 after it has left a head box, has its static pressure increased at the shoe portions, and is dewatered through the wires 3 and 4, but the pressure generated in the water in the raw material by means of the scraping effect of the grooved shoes 2' is released through the grooves 6 and, thereby, the peak value of the pressure within the raw material 1 sandwiched between the two wires 3 and 4 can be reduced. In addition, because the water flows in the transverse direction from the contact part 7 into the grooves 6, and because scraping does not occur with these grooves, fibres can also be directed in the transverse direction.

If the peak value of the pressure within the raw material is reduced in the above-described manner, then the retention rate is improved, the velocity of local flow in the direction of travel is also reduced, and the machine-direction to cross-machine-direction ratio is improved. Also, the difference between the lengthwise and widthwise terms in this ratio can be further reduced owing to the flow of water in the transverse direction.

In order to prevent streaks from appearing on the paper, caused by the presence of the grooves 6, the latter are preferably angled with respect to the direction of travel of the wires 3 and 4, normally within the range of 10° to 60°. Also, the effect of improvement in the retention rate and in the machine-direction to cross-machine-direction ratio of the paper is larger for a wider groove. However, it is important that the grooves are not so wide that the wires can hang in the grooves and thus cause harmful effects such as streaks. Normally, a groove width of 1 to 10 mm is preferred. Furthermore, the grooves should have a sufficient depth so as to prevent white water from filling the groove when the dewatered white water passes through the grooves. To that end, normally a depth of 1 mm or more is necessitated. If the depth is too great, then a problem could arise with respect to the mechanical strength of the paper. Normally, the depth would not exceed 10 mm. Although it is desirable to make the pitch spacing of the grooves as small as possible, there is a lower limit for such pitch spacing based on considerations mechanical strength. A pitch spacing in the range of 6 to 30 mm is preferred, although this depends to some extent upon the material of the shoe.

I claim:

1. In a twin wire former of a paper making machine having two wires extending in a longitudinal direction for guiding a raw paper material liquid therebetween and a plurality of longitudinally spaced forming shoes, one of the wires being supported on a surface of each of the shoes, the improvement wherein each of said forming shoes has a plurality of transversely spaced grooves in said surface, each of said plurality of grooves extending perpendicularly to its depth in a direction at an angle to said longitudinal direction less than 90° such that scraping pressure applied to said raw paper material liquid by said surface between said grooves is released by said raw paper material liquid into said grooves, said grooves creating a pressure difference in said raw paper material liquid in a direction transverse to said longitudinal direction to produce a transverse flow of said raw paper material liquid, thereby to reduce the machine-direction to cross-machine-direction ratio of the fibers of the paper being formed.

2. The improvement as in claim 1, wherein said angle is in the range 10° to 60°, the width and depth of said grooves are each in the range 1 to 10 mm, and the pitch spacing of said grooves is in the range 6 to 30 mm.

* * * * *